US010676999B2

(12) United States Patent
Roodenburg et al.

(10) Patent No.: US 10,676,999 B2
(45) Date of Patent: Jun. 9, 2020

(54) SUBSEA WELLBORE OPERATIONS VESSEL AND METHOD

(71) Applicant: ITREC B.V., Schiedam (NL)

(72) Inventors: Joop Roodenburg, Schiedam (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 16/240,158

(22) Filed: Jan. 4, 2019

(65) Prior Publication Data

US 2019/0136646 A1 May 9, 2019

Related U.S. Application Data

(62) Division of application No. 15/539,583, filed as application No. PCT/NL2015/050885 on Dec. 18, 2015, now Pat. No. 10,202,811.

(30) Foreign Application Priority Data

Dec. 24, 2014 (NL) ..... 2014064

(51) Int. Cl.
*E21B 19/00* (2006.01)
*B63B 35/44* (2006.01)
(Continued)

(52) U.S. Cl.
CPC ..... *E21B 19/004* (2013.01); *B63B 35/4413* (2013.01); *E21B 15/02* (2013.01);
(Continued)

(58) Field of Classification Search
CPC ..... E21B 19/115; E21B 19/16; B63B 35/4413
See application file for complete search history.

(56) References Cited

U.S. PATENT DOCUMENTS 3,313,345 A * 4/1967 Fischer ..... E21B 7/128 166/355
3,526,425 A 9/1970 Langowski et al.
(Continued)

FOREIGN PATENT DOCUMENTS

KR 10-2012-0133563 A 12/2012
WO WO 2009/048322 A1 4/2009
(Continued)

OTHER PUBLICATIONS

International Search Report issued in PCT/NL2015/050885 (PCT/ISA/210), dated May 4, 2016.
(Continued)

*Primary Examiner* — James G Sayre
*Assistant Examiner* — Aaron L Lembo
(74) *Attorney, Agent, or Firm* — Birch, Stewart, Kolasch & Birch, LLP

(57) ABSTRACT

A vessel adapted to perform subsea wellbore related operations involving a riser string that is assembled from releasably interconnected riser sections and extends between a subsea wellbore and the vessel. The riser string vertical handling system of the vessel comprises a controlled motion device that is adapted to displace the riser string lifting tool in at least one horizontal direction relative to the riser spider device at least whilst travelling between said elevated and lowered position thereof loaded by the riser string suspended from the riser string lifting tool, thereby allowing to establish an inclined travel path with selectively variable inclination of the riser string lifting tool relative to an imaginary vertical line through the riser string passage of the riser spider device, e.g. said inclined travel path having an inclination selected to correspond to an actual water current induced inclination of an upper portion of the riser string during the riser string assembly process.

15 Claims, 10 Drawing Sheets

(51) Int. Cl.

| | |
|---|---|
| ***E21B 15/02*** | (2006.01) |
| ***E21B 19/09*** | (2006.01) |
| ***E21B 19/10*** | (2006.01) |
| ***E21B 19/16*** | (2006.01) |
| *B63B 3/14* | (2006.01) |
| *E21B 19/14* | (2006.01) |
| *E21B 19/15* | (2006.01) |

(52) U.S. Cl.
CPC ..... *E21B 19/008* (2013.01); *E21B 19/09* (2013.01); *E21B 19/10* (2013.01); *E21B 19/16* (2013.01); *B63B 2003/147* (2013.01); *E21B 19/143* (2013.01); *E21B 19/155* (2013.01)

(56) References Cited

U.S. PATENT DOCUMENTS

| | | | | |
|---|---|---|---|---|
| 3,955,798 | A | 5/1976 | Meyer | |
| 3,984,990 | A * | 10/1976 | Jones | E21B 17/012 405/224.2 |
| 4,199,847 | A * | 4/1980 | Owens | E21B 19/004 188/67 |
| 4,351,027 | A * | 9/1982 | Gay | E21B 41/0014 114/144 B |
| 5,395,183 | A | 3/1995 | Watkins | |
| 8,573,308 | B2 | 11/2013 | Baugh | |
| 8,590,474 | B2 | 11/2013 | Roodenburg et al. | |
| 9,284,796 | B2 * | 3/2016 | Hoefler | E21B 17/01 |
| 9,587,447 | B2 * | 3/2017 | Roodenburg | E21B 19/10 |
| 2014/0151057 | A1 * | 6/2014 | Wijning | E21B 19/006 166/352 |
| 2017/0321490 | A1 * | 11/2017 | Haavind | E21B 15/02 |

FOREIGN PATENT DOCUMENTS

| | | |
|---|---|---|
| WO | WO 2009/102196 A1 | 8/2009 |
| WO | WO 2009/102197 A2 | 8/2009 |
| WO | WO 2013/012317 A1 | 1/2013 |
| WO | WO 2014/168471 A1 | 10/2014 |

OTHER PUBLICATIONS

Written Opinion of the International Searching Authority issued in PCT/NL2015/050885 (PCT/ISA/237), dated May 4, 2016.

* cited by examiner

SUBSEA WELLBORE OPERATIONS VESSEL AND METHOD

CROSS-REFERENCE TO RELATED APPLICATIONS

This application is a Divisional of U.S. application Ser. No. 15/539,583, filed on Jun. 23, 2017, which is the National Phase under 35 U.S.C. § 371 of International Application No. PCT/NL2015/050885, filed on Dec. 18, 2015, which claims priority under 35 U.S.C. § 119(a) to Application No. 2014064, filed in the Netherlands on Dec. 24, 2014, all of which are hereby expressly incorporated by reference into the present application.

FIELD OF THE INVENTION

A first aspect of the present invention relates to vessel adapted to perform subsea wellbore related operations involving a riser string between the subsea wellbore and the vessel, e.g. drilling and/or wellbore intervention.

BACKGROUND OF THE INVENTION

In the field it is common to store multiple riser sections from which the subsea riser string is composed in a riser storage of the vessel.

Commonly a riser section comprises a main riser pipe and in many known embodiments additionally one or more auxiliary pipes, also often identified as service, satellite, or peripheral pipes. The auxiliary pipes extend on the outside of and along the main riser pipe. The auxiliary pipes e.g. include a choke line, a kill line, one or more hydraulic lines, e.g. used as fluid lines to a BOP or other subsea equipment, booster lines, injection lines (e.g. for glycol), etc. Each riser section comprises a connector fitting arrangement at each end thereof. For example the connector fitting arrangement includes a flange having bolt holes, with riser sections being joined by interconnecting flanges by means of bolts. An auxiliary pipe may have an individual connector end fitting, e.g. a bayonet fitting, or be designed to fit sealingly into the auxiliary pipe of an adjoining riser section without direct axial securing of the auxiliary pipes. In practical embodiments a riser section is often provided with one or more buoyancy members and/or thermal insulation members, e.g. of plastic foam material, but so-called bare joints are also employed.

Riser sections come in different lengths. Commonly riser sections have lengths between 50 ft. (15.24 meters) and 90 ft. (27.43 meters). A most common length is 75 ft. (22.86 meters).

Riser sections are commonly heavy; far heavier than other tubulars used in the offshore drilling industry. For example a single 75 ft. subsea riser section may weigh between 20 and 25 tonnes, which is incomparable to the weight of an equally long drill pipe. Therefore riser handling is subject to different considerations than drill pipe handling, mainly in view of their size and weight.

For example WO2009/102196 discloses a mono-hull vessel having a hull and a riser storage hold within the hull. In the riser storage hold riser sections are stacked in horizontal orientation. A crane is provided to raise and lower the riser sections out of and into the storage hold and to place each individual riser section onto a riser catwalk machine or to pick up a riser section from the catwalk machine. The leading end of the riser section is in practice connected to a riser string lifting tool which connects the riser section to a riser string capacity hoisting device of the vessel. By raising the lifting tool and operation of the catwalk machine the riser section is brought into a vertical orientation, or upended, in line with a firing line along which the riser string is suspended into the sea. The already launched portion of the riser string is then temporarily held by a riser string hanger, often referred to as a riser spider device, of the vessel. The new riser section is then held in alignment above the launched riser string and the connector fitting arrangements are interconnected to join the new riser section to the riser string. Then the riser string is released by the riser spider device and lowered over the length of the newly attached section. The riser string is then suspended again from the riser spider device and the process of adding and joining a new riser section is repeated.

In WO2014/168471 it is discussed that this process to assemble a riser string is time-consuming and in view thereof the use of significantly longer riser sections is proposed. For example this prior art document proposes the use of individual riser sections, or pre-assembled riser sections called stands, that have a length of between 100 ft. (30.48 m) and 180 ft. (54.86 m), e.g. of 120 ft. (36.57 m). A prominent example is a length of 150 ft. (45.72 m).

OBJECT OF THE INVENTION

The present invention aims to propose measures that allow for improvements over the known approaches for assembly of a riser string.

The present invention further aims to propose measures that allow for the passage of the riser string through the riser spider device without the riser string, e.g. the buoyancy members thereof, becoming damaged, e.g. by scraping along the riser spider device and/or hooking onto said riser spider device.

Also the invention aims to propose measures that allow to avoid any contact or at least undue contact between the riser string and the riser spider device, which contact may cause excessive side loads on the riser string as the riser string passes through the riser spider device.

Another aim of the invention is to provided measures that allow for optimal contact between the riser spider dogs and the riser string when the riser string is brought into contact with the riser spider dogs, e.g. a flange of the riser section is landed onto the riser spider dogs.

SUMMARY OF THE INVENTION

The first aspect of the invention proposes a vessel adapted to perform subsea wellbore related operations involving a riser string between the subsea wellbore and the vessel, e.g. drilling and/or wellbore intervention, In this vessel the riser string vertical handling system comprises a controlled motion device that is adapted to displace the riser string lifting tool in at least one horizontal direction relative to the riser spider device at least whilst travelling between said elevated and lowered positions thereof loaded by the riser string suspended from the riser string lifting tool, thereby establishing an inclined travel path with selectively variable inclination of the riser string lifting tool relative to an imaginary vertical line through the riser string passage of the riser spider device.

For example, and as preferred, the inclined travel path established by the controlled motion device has an inclination that is selected to correspond to an actual water current induced inclination of an upper portion of the riser string during the riser string assembly process.

The inventive vessel for example allows to lower, with at least the upper portion of the riser string being inclined, e.g. due to water current, the riser string with the newly joined riser section in a manner through the riser spider device wherein damaging collision between the two is avoided or significantly reduced. This e.g. allows for a relatively small gap between the riser spider device and the riser string during the lowering procedure, which is advantageous in view of the structural design and of the loads to which parts of the riser spider device, e.g. any riser dogs thereof, are subjected.

It will be appreciated that the inventive vessel may equally be of advantage during the disassembly or tripping of the riser string.

In an embodiment the tower and the riser string vertical handling device are adapted to handle riser sections having a length of at least 100 ft. (30.48 m), e.g. between 100 ft. (30.48 m) and 180 ft. (54.86 m), e.g. of 120 ft. (36.57 m), more preferably of 150 ft. (45.72 m). It is noted that with an increase of the riser section length the provision of the first aspect of the invention becomes increasing advantageous. It is however noted that the one or more advantages mentioned herein also apply when common length riser sections, e.g. 75 ft. riser sections, are being handled by the vertical system.

In practice operational conditions may occur wherein the water current causes a noticeable inclination of the launched riser string. In practice inclinations of 1° or 2° are observed, whereas in more extreme situations the inclination may be up to 5°.

In an embodiment the controlled motion device is adapted to displace the riser string lifting tool, at least whilst travelling between said elevated and lowered positions thereof loaded by the riser string suspended from the riser string lifting tool, in one horizontal direction relative to the tower at least over 0.5 meter, e.g. between 0.75 and 1.50 meter. For example the tower and the riser string vertical handling device are adapted to handle riser sections having a length of 150 ft. (45.72 m).

In an embodiment the riser string vertical handling system is adapted to establish an inclined travel path with selectively variable inclination of the riser string lifting tool relative to an imaginary vertical line through the riser string passage of the riser spider device that is within 5°.

Often the vessel will be oriented during the riser string assembly or disassembly process with its bow into the sea current, e.g. held in position by a dynamic positioning system of the vessel, e.g. the system including azimuthable thrusters. The inclination will then be directed in a plane coinciding or parallel to a median longitudinal plane of the vessel, with the launched riser string directed rearward and away from an imaginary vertical line through the riser string passage of the riser spider device.

It is also observed that large diameter riser sections are used nowadays that have an outer diameter that is only slightly smaller than the diameter of the riser string passage of the riser spider device. For example the passage in the riser spider device may have a diameter of 60 inch (1.52 meter), whereas the riser section has an outer diameter of 54 inch (1.37 meter). This leaves just a 3 inch (0.075 meter) gap between the riser string and the riser spider device when the riser string is exactly in the center of the passage.

By means of the inventive system with the controlled motion device it is possible to lower the inclined riser string with the new riser section through the passage of the riser spider device without damaging contact or at least with significant reduction thereof.

It is observed that if one would seek to use, as an alternative to the first aspect of the invention, a riser spider device with a significantly larger diameter passage therein to create a significantly broader gap, such an approach would place extreme load bearing and thus structural demands on the riser spider device. For example the mobile dogs of such riser spider device would have to bridge a very large gap and thus be subjected to even larger bending loads than the already enormous loads to which they are subjected, e.g. in view of deep water applications wherein the riser length may be in the range of 10.000 ft. (3000 meters).

One may consider to use a splittable riser spider device that is composed of two or more segments. These devices are known in the art, with the splittability commonly being used to arrange the riser spider device around a riser string or to remove the riser spider device from around a riser string. In the context of the present invention, e.g. the first aspect thereof, one may, in an embodiment, seek to create an increased distance between the disengaged riser spider device and the riser string during the lowering thereof by splitting the riser spider device and moving one or more of the segments of the riser spider device away from the riser string so into a retracted segment position relative to an operative position of the segment. This approach is however considered rather time consuming and complex. In embodiments this approach may further require the use of a riser centralizer device, e.g. arranged within the moonpool and/or just below the riser spider device, to keep ultimate control of the riser string within the moonpool and to allow bringing the one or more segments of the riser spider device back into operative position around the riser string again after the riser string has been sufficiently lowered and has to be engaged again by the riser spider device. An example of a riser centralizer is disclosed in U.S. Pat. No. 8,573,308.

It is noted that the invention does not exclude the structural enlargement of the diameter of the passage in the riser spider device nor the splitting of a splittable riser spider device to avoid riser string damage, nor the use of a riser centralizer device. However, it is believed that proper selection of the inclined path of the riser lifting tool, at least whilst travelling between said elevated and lowered positions thereof loaded by the riser string suspended from the riser string lifting tool, preferably dependent on a measurement of the actual inclination of the riser string, e.g. a measurement performed whilst the riser string is suspended from the riser spider device, will allow to achieve one or more of the stated objectives in absence of the optional features mentioned in this paragraph.

In a preferred embodiment the controlled motion device is adapted to displace the riser string lifting tool in at least one horizontal direction relative to the tower at least whilst travelling between said elevated and lowered position thereof loaded by the riser string suspended from the riser string lifting tool, thereby allowing to establish an inclined travel path with selectively variable inclination of the riser string lifting tool relative to an imaginary vertical line through the riser string passage of the riser spider device. This embodiment can e.g. be combined with the riser spider device being mounted or held at a stationary position, at least in a horizontal plane, relative to the tower during the process of assembly of the riser string.

In a preferred embodiment the riser string lifting tool is displaceable mounted on the travelling device so as to allow displacement of the riser string lifting tool relative to the travelling device in said at least one horizontal direction, and the controlled motion device is arranged between said riser string lifting tool and said travelling device. For example the controlled motion device comprises one or more hydraulic cylinders or hydraulic rotary shaft motors, or electric drive motors.

In an embodiment the vessel is provided with one or more riser string inclination sensors that are adapted to detect the actual water current induced inclination of an upper portion of the riser string during the riser string assembly process. Preferably the one or more riser string inclination sensors are linked to a control unit that is also linked to said controlled motion device, wherein said control unit is adapted to select and/or vary the inclined travel path of the riser string lifting tool on the basis of output of said one or more riser string inclination sensors.

In an embodiment one or more riser string inclination sensors are fitted on the riser spider device.

In an embodiment the riser spider device comprises a base and a riser dogs carrying part comprising multiple dogs that are movable between a retracted position, wherein the dogs are disengaged from the riser string, and an operative position, wherein the riser dogs are engaged with the riser string and support the riser string. The riser dogs carrying part is inclinable relative to the base, e.g. allowing the riser dogs carrying part to have an inclination that corresponds to the actual water current induced inclination of an upper portion of the riser string that is suspended from said riser dogs, e.g. the riser section having a flange resting onto said riser dogs. Such riser spider devices are known in the art. Often the portion that allows for the inclination is identified as the gimbal device or gimballing part of the riser spider device. Examples hereof are e.g. shown in U.S. Pat. Nos. 3,984,990, 4,199,847, and 5,395,183. Generally these known gimbal devices allow for the riser dogs carrying part to assume an inclination as a result of being engaged with the riser string, e.g. as the riser dogs support a flange of a riser section. In an embodiment the one or more riser string inclination sensors are adapted to measure the inclination of the riser dogs carrying part relative to the base, e.g. the one or more sensors being fitted between the base and the dogs carrying part. The measurement of the inclination of the riser digs carrying part will, for example, allow for a method wherein the inclination is measured after a new section has been fitted to the launched riser string and prior to disengagement of the riser spider device from the riser string. This value of the inclination is then used to steer the controlled motion device, e.g. select the appropriate inclination of the path of the riser lifting tool during its descend whilst lowering the riser string. One could also envisage an approach wherein this inclination value is measured prior to the new section being secured to the launched riser string held by the riser spider device, with the controlled motion device being steered to bring the new section in line with the inclined upper portion of the riser string on the basis of this measurement and then the securing of the new riser section to the string being performed, e.g. using connector bolts. Subsequently the riser lifting tool holding the weight of the entire string, after disengagement of the riser spider device, is lowered along the path with the measured inclination.

In an embodiment, e.g. in combination with the provision of one or more riser string inclination sensors or in absence thereof, the vessel is provided with one or more riser string centering sensors that are adapted to detect the actual position—in a horizontal plane—of the riser string relative to the riser string passage in the riser spider device. Preferably the one or more riser string centering sensors are linked to a control unit that is also linked to said controlled motion device, wherein said control unit is adapted to select and/or vary the inclined travel path of the riser string lifting tool on the basis of output of said one or more riser string centering sensors. For example the one or more centering sensors are employed to detect whether the riser string is off center and/or close to one side of the passage or even touching the riser spider device at said side, e.g. whilst suspended from the riser spider device or, in a more practical embodiment, after being released from the riser spider device yet before the lowering by means of the riser string lifting tool. The output from the one or more centering sensors is then used in the control unit, or visualized for use by a human operator of the controlled motion device, so that during at least a major portion of the lowering step of the riser string, e.g. even before the start of the lowering step, the controlled motion device positions the riser lifting tool so as to bring the riser string in a more centered position, e.g. at least avoiding damaging collision between the two. The centering sensor can e.g. be a camera, a laser distance measuring device, or any other device that provides information on the distance.

In an embodiment the riser spider device comprises a base and a dogs carrying part comprising multiple dogs that are movable between a retracted position wherein the dogs are disengaged from the riser string and an operative position wherein the dogs are engaged with the riser string and support the riser string, and wherein the riser dogs carrying part is inclinable relative to the base, e.g. allowing the riser dogs carrying part to have an inclination corresponding to the actual water current induced inclination of an upper portion of the riser string. Such riser spider devices are known in the art. Often the portion that allows for the inclination is identified as the gimbal device or gimballing part of the riser spider device. Examples hereof are e.g. shown in U.S. Pat. Nos. 3,984,990, 4,199,847, and 5,395,183. Generally these known gimbal devices allow for the dogs carrying part to assume an inclination as a result of being engaged with the riser string, e.g. as the dogs support a flange of a riser section. So the known gimbal devices in a riser spider device passively respond to the inclination of the riser string.

The invention envisages, also as a second inventive aspect thereof, an embodiment of a riser spider device which comprises a controlled inclination actuator that is arranged between the base and the riser dogs carrying part and is adapted to allow for selective variation of the inclination of the riser dogs carrying part relative to the base, e.g. said inclination being selected and set to correspond to the actual water current induced inclination of an upper portion of the riser string during the riser string assembly process prior to engagement of the riser dogs with the riser string. So, for example, one can measure the inclination prior to the riser string being released, then lower the riser string over the length of the newly added section, and then bring the riser dogs carrying part in an inclination that corresponds to the previously measured inclination. This is e.g. advantageous in an embodiment wherein a gimbal device in the riser spider device is embodied with one or more resilient or spring type members that return the dogs carrying part to a non-inclined position as soon as the riser dogs are disengaged from the riser string. The actuator can then bring the riser dogs carrying part back into its inclined position ahead of the renewed engagement with the then lowered riser string. This e.g. allows to avoid that a flange of a riser section first lands on one or a limited number of riser dogs and so has to induce, forcefully, the inclination of the riser dogs carrying part so that all riser dogs support the flange of the riser section. This e.g. allows to reduce load requirements on the riser dogs due to landing of the riser string on the dogs and/or reduce load requirements on flanges on riser sections that are landed on the riser dogs. For example the controlled inclination actuator comprises a hydraulic cylinder, a screw spindle mechanism, etc. Preferably the controlled inclination actuator is disengaged and/or brought in a free motion mode when the riser string is suspended from the riser dogs so that the actuator does not interfere with the gimbal device in the riser spider device.

The invention furthermore envisages, also as a third aspect of the invention, an embodiment of the riser spider device wherein the entire riser spider device or at least a riser dogs carrying part thereof is mounted, e.g. on a working deck of the vessel, so as to be displaceable in the said at least one horizontal direction whilst being disengaged from the riser string, and wherein a controlled riser spider displacement actuator is provided to establish said displacement. It will be appreciated that, e.g. in combination with one or more centering sensors as discussed herein, this mobility allows to avoid damaging collision with the riser string even when oriented and lowered at an inclination, e.g. induced by water current. For example the riser spider device is skiddable in at least one horizontal direction over skid rails by a skid propulsion system, e.g. allowing to skid the spider device whilst supporting the weight of the entire riser string, e.g. including a BOP and/or other subsea equipment at the lower end thereof. For example the riser spider device is skiddable mounted on a working deck, e.g. a mobile working deck as discussed herein, or the one or more skid rails are independent structural elements, e.g. on which the working deck is also supported.

In an embodiment the controlled riser spider displacement actuator is linked to a control unit that is also linked to one or more riser string centering sensors, wherein said control unit is adapted to control said horizontal direction displacement on the basis of output of said one or more riser string centering sensors, e.g. in order to avoid contact between the riser string and the riser spider or riser dogs portion thereof during the passage of the riser string through the riser string passage of the riser spider device.

In an embodiment the moonpool has lateral sides, a front side and a rear side, and the tower is embodied as a hollow construction mast having a top and having a base that is integral with the hull, the base extending between sections of the hull on opposed lateral sides of the moonpool, the base being spaced from each of the front side and the rear side of the moonpool, thereby forming a front moonpool area forward of the mast and a rear moonpool area rearward of the mast, wherein the mast has a front side and an opposed rear side as well as opposed lateral sides.

In an embodiment the vessel has a second hoisting device, having a load attachment device which is movable up and down relative to the tower, e.g. relative to the mast at a side opposed from the riser firing line, so as to allow for handling of items passing through the other moonpool area along a second firing line distinct and spaced from the first firing line where the riser string assembly takes place. Preferably said second hoisting device is embodied as a drilling drawworks, e.g. a topdrive suspended from the load attachment device to perform drilling operations and/or a coiled tubing drilling device is arranged the side of the second hoisting device.

In an embodiment he vessel is provided with a riser string support cart that is displaceable within the moonpool between two firing lines allowing to assembly a riser string in a riser string firing line, e.g. at the rear moonpool area, and then to transfer the riser string to a drilling firing line, e.g. at a front moonpool area. For example this cart is embodied as a skid cart that can be skidded over a pair of associated skid rails which extend in longitudinal direction along the moonpool, allowing to displace the cart in longitudinal direction of the moonpool while supporting a riser string by means of a second riser spider device (and preferably with a BOP attached to the lower end of the riser string) lowered into the sea, generally between the one moonpool area and the other moonpool area, so underneath the base of the mast.

In an embodiment the riser string support cart is also embodied to support a blow-out preventer or blow-out preventer module thereon, so with the cart underneath the blow-out preventer or module thereof.

Preferably one or both of the riser string vertical handling system and—if present—the second firing line hoisting device comprises one or more cables and one or more associated winches.

Preferably one or both of the riser string vertical handling system and—if present—the second firing hoisting device comprises a heave compensation mechanism.

It is envisaged that—if present—the riser stand transfer opening is oriented with its length towards the moonpool, preferably along or parallel to a central axis of the vessel if the vessel is a monohull vessel. E.g. the vessel has a riser storage hold for pre-assembled riser stands aft of the moonpool.

In an embodiment, e.g. as shown in WO2009102197, the vessel comprises a working deck, e.g. a mobile working deck, extending above the moonpool, said working deck being provided with a riser spider device adapted to support a riser string there from in the firing line.

For example the working deck is guided along one or more vertical rails mounted on the tower, e.g. along a side of a mast, so as to allow for vertical translatory motion of the working deck. In another embodiment the working deck is pivotally mounted on the hull of the vessel, e.g. pivotal about an axis transverse to the longitudinal axis of the vessel, preferably said pivot axis extending on one transverse side of a moonpool or moonpool area with a mast being arranged on the other transverse side of the moonpool or moonpool area. In other embodiment the working deck is horizontally displaceable between an operative position wherein the riser handling firing line intersects the working deck, e.g. extends through an opening therein, e.g. an opening where the riser spider device is arranged, and a retracted position wherein the moonpool (at least in an area around the firing line) is uncovered, e.g. to allow for the handling of a BOP or other subsea equipment.

In an embodiment, in particular in a mono-hull vessel, e.g. as shown in WO2009048322, the vessel comprises a ballast system, e.g. allowing to compensate for mass of riser sections stored in a riser storage and/or for mass of blow out preventers stored in a BOP storage. The ballast system may include one or more ballast tanks to be filled with water for balancing.

In an embodiment the ballast system comprises a solid ballast mass device which includes a solid ballast which is movable in the transverse direction of the hull, e.g. in an embodiment with the riser storage and BOP storage holds side by side in transverse direction of the hull. The solid ballast may have a total mass of at least 100 ton, preferably between 100 and 750 tons, e.g. a mass of between 200 and 400 tons. The solid mass ballast may be formed by one or more solid masses that are mounted on and guided along rails transverse to the hull of the vessel. The masses may then be positioned to compensate for the weight of riser stands and/or blow-out preventer (modules) during assembly of a riser string.

In an embodiment the same solid mass ballast device may be embodied to act—if desired—as active roll damping mechanism, the device further including:

a sensor detecting the rolling motion of the hull, and a drive and control system operable to cause and control the movements of the solid ballast in response to the detections of the sensor to provide roll stabilization. For example a winch and cable arrangement is provided to move the ballast masses, either continuously in synchronization with sea-motion of the vessel or to a desired position to obtain a balancing moment.

In an embodiment the riser storage and BOP storage are arranged aft of the moonpool of the vessel and the solid mass ballast device is arranged in the hull between the riser storage and the moonpool.

The vessel can be of different embodiments, yet a mono-hull vessel is in particular contemplated. The vessel could however also be, for example, a semi-submersible vessel with parallel pontoons and columns supporting a deck box structure or with an annular pontoon, e.g. for arctic environments.

The first aspect of the invention also relates to a method for performing a subsea wellbore related operation involving a riser string that is assembled from releasably interconnected riser sections and extends between a subsea wellbore and the vessel, e.g. drilling and/or wellbore intervention, wherein use is made of a vessel as described herein. As discussed it is envisaged that by operating the controlled motion device the riser string lifting tool is displaced in at least one horizontal direction relative to the riser spider device whilst travelling between the elevated and the lowered position thereof and whilst supporting the riser string, thereby establishing an inclined travel path of the riser string lifting tool relative to an imaginary vertical line through the riser string passage of the riser spider device, preferably this inclined travel path having an inclination selected to correspond to an actual water current induced inclination of an upper portion of the riser string during the riser string assembly process. As discussed the inclination of said path is preferably chosen so as to avoid collision of the riser string against the riser spider device during said lowering.

In an embodiment the riser spider device comprises a base and a dogs carrying part comprising multiple dogs that are movable between a retracted position wherein the dogs are disengaged from the riser string and an operative position wherein the dogs are engaged with the riser string and support the riser string, and wherein the riser spider device comprises a gimballing portion between the base and the dogs carrying part, whereby the riser dogs carrying part is inclinable relative to the base allowing the riser dogs carrying part to have an inclination corresponding to the actual water current induced inclination of an upper portion of the riser string suspended in the water, wherein, prior to connecting, e.g. by bolts, a new riser section onto the upper end of a riser string held at a water current induced inclination in the riser spider device, the new riser section is retained with its lower end vertically above the upper end of the riser string and the upper end of the new riser section is positioned by means of the controlled motion device such that the new riser section is oriented at an inclination which corresponds to the actual water current induced inclination of an upper portion of the riser string, and wherein the new riser section oriented at said inclination is connected to said upper end of the riser string.

The first aspect of the invention also relates to a method for assembly of a riser string by interconnecting riser sections, which riser string is adapted to extend between a subsea wellbore and a vessel in order to perform a subsea wellbore related operation involving said riser string, wherein use is made of a vessel comprising:

a floating hull; e.g. a mono-hull type hull, a riser storage wherein multiple risers sections are stored, a moonpool in said hull, a tower arranged at said moonpool and fixed to said hull, a riser string vertical handling system comprising:

a travelling device that is movable up and down along the tower, e.g. guided by one or more vertical rails mounted on the tower, e.g. a wheeled travelling device having wheels engaging said one or more vertical rails, a riser string lifting tool mounted on said travelling device and adapted to connect to an end of a riser section, which riser string lifting tool is embodied to support the weight of a riser string, a hoisting device by which said travelling device and/or said riser string lifting tool is suspended from the tower and which allows to move riser string connected thereto via the riser string lifting tool in unison with the travelling device up and down relative to the tower, preferably said hoisting device comprising at least one winch and at least one cable, wherein the travelling device and/or said riser string lifting tool is suspended from said at least one cable, a riser spider device that is supported above the water in the moonpool and is adapted to temporarily suspend therefrom a riser string into the sea during the riser assembly and disassembly process, which riser spider device has a riser string passage therein through which the riser string passes, preferably said riser spider device being mounted on a working deck which extends, e.g. in an operative position thereof, above at least an area of the water in the moonpool, wherein—in the riser string assembly process—an assembled riser string is temporarily suspended from the riser spider device and a new riser section is connected to the riser string lifting tool and positioned above an upper end of the assembled riser string and then connected thereto, after which the riser spider device is disengaged from the riser string and the riser string is lowered by the riser string vertical handling system wherein the riser string lifting tool moves from an elevated position to a lowered position thereof allowing the new upper end of the assembled riser string to be engaged by the riser spider device, wherein the riser spider device comprises a base and a dogs carrying part comprising multiple dogs that are movable between a retracted position wherein the dogs are disengaged from the riser string and an operative position wherein the dogs are engaged with the riser string and support the riser string, and wherein the riser spider device comprises a gimballing portion between the base and the dogs carrying part, whereby the riser dogs carrying part is inclinable relative to the base allowing the riser dogs carrying part to have an inclination corresponding to the actual water current induced inclination of an upper portion of the riser string suspended in the water, wherein the riser string vertical handling system comprises a controlled motion device that is adapted and operated to displace the riser string lifting tool in at least one horizontal direction relative to an imaginary vertical line through the riser string passage of the riser spider device, and wherein, prior to connecting, e.g. by bolts, a new riser section onto the upper end of a riser string held at a water current induced inclination in the riser spider device, the new riser section is retained with its lower end vertically above the upper end of the riser string and the upper end of the new riser section is positioned by means of the controlled motion device such that the new riser section is oriented at an inclination which corresponds to the actual water current induced inclination of an upper portion of the riser string, and in that the new riser section oriented at said inclination is connected to said upper end of the riser string.

In an embodiment the new riser section is retained with its lower end vertically above the upper end of the riser string by means of a tailing-in arm device, e.g. said tailing-in arm device being mounted on the frame of a catwalk machine.

The second aspect of the present invention relates to a riser spider device comprises a base, a gimballing part, and a riser dogs carrying part comprising multiple riser dogs that are movable between a retracted position, wherein the dogs are disengaged from the riser string, and an operative position, wherein the dogs are engaged with the riser string and support the riser string, and wherein the gimballing part allows for the riser dogs carrying part to be inclinable relative to the base, at least about one axis, e.g. allowing the riser dogs carrying part to have an inclination corresponding to actual water current induced inclination of an upper portion of the riser string suspended from the riser spider device.

Such riser spider devices are known in the art. Examples hereof are e.g. shown in U.S. Pat. Nos. 3,984,990, 4,199,847, and 5,395,183. Generally the known gimballing parts allow for the dogs carrying part to assume an inclination as a result of being engaged with the riser string, e.g. as the dogs support a flange of a riser section. So the gimballing parts in a riser spider device passively respond to the inclination of the riser string.

As explained above the second aspect of the invention proposes to provide such a riser spider device with a controlled inclination actuator that is arranged between the base and the riser dogs carrying part and is adapted to allow for selective variation of the inclination of the riser dogs carrying part relative to the base.

For example the inclination of the riser dogs carrying part is selected and set to correspond to an actual water current induced inclination of an upper portion of the riser string during the riser string assembly process prior to engagement of the riser string with the riser dogs, e.g. prior to a flange of an upper riser section of the riser string landing on the riser dogs.

As explained herein the second aspect of the invention may be applied in an embodiment wherein the gimballing part comprises resilient and/or spring members that restore the dogs carrying part to a non-inclined, horizontal, position once the spider device is disengaged from the riser string. Then the controlled inclination actuator may be used to bring the riser dogs carrying part in a selected inclined orientation ahead of the landing of the riser string onto the riser dogs.

As explained it is envisaged that the controlled inclination actuator is rendered inactive, e.g. in a free motion mode, once the riser string is suspended from the riser spider, so that this actuator does not interfere with the gimballing effect.

As explained the riser spider device may be provided with an inclination sensor that directly or indirectly measures actual inclination of the riser dogs carrying part.

As explained it is envisaged that a measurement of the actual inclination is done prior, e.g. just prior, to the release of the riser string from the riser spider, with this measurement being used as input to steer the inclination actuator.

In an embodiment the inclination actuator of the riser spider device is adapted to cause controlled inclination of the riser dogs carrying part about solely a single horizontal axis, e.g. in axis parallel to the vessels longitudinal axis. As explained it is envisaged that in practice the vessel will be directed with its bow into the water current, so that water current induced inclination of the upper portion of the riser string will take place in a plane parallel to the longitudinal axis of the vessel so that it suffices in the context of at least the second aspect of the invention to have only a single axis about which the inclination actuator should perform its function.

In an embodiment the riser spider controlled inclination actuator is linked to a control unit, e.g. a computerized control unit, e.g. this unit also be linked to the mentioned controlled motion device.

The third aspect of the present invention relates to vessel adapted to perform subsea wellbore related operations involving a riser string that is assembled from releasably interconnected riser sections and extends between a subsea wellbore and the vessel, e.g. drilling and/or wellbore intervention, said vessel comprising:

- a floating hull; e.g. a mono-hull type hull,
- a riser storage adapted to store therein multiple risers sections (8*a*),
- a moonpool in said hull,
- a tower arranged at said moonpool and fixed to said hull,
- a riser string vertical handling system comprising:
  - a riser string lifting tool mounted on said travelling device and adapted to connect to an end of a riser section, which riser string lifting tool is embodied to support the weight of a riser string,
  - a hoisting device by which said travelling device and/or said riser string lifting tool is suspended from the tower and which hoisting device is adapted to move the riser string connected thereto via the riser string lifting tool up and down relative to the tower, preferably said hoisting device comprising at least one winch and at least one winch driven cable, wherein the travelling device and/or said riser string lifting tool is suspended from said at least one cable,
- a riser spider device that is supported above the water in the moonpool and is adapted to temporarily suspend therefrom a riser string into the sea at least during the riser assembly and disassembly process, which riser spider device has a riser string passage therein through which the riser string passes, preferably said riser spider device being mounted on a working deck which extends, e.g. in an operative position thereof, above at least an area of the water in the moonpool, wherein—in a riser string assembly process—an assembled riser string is temporarily suspended from the riser spider device and a new riser section is connected to the riser string lifting tool and positioned above an upper end of the assembled riser string and then connected thereto, after which the riser spider device is disengaged from the riser string and the riser string is lowered by the riser string vertical handling system wherein the riser string lifting tool moves from an elevated position to a lowered position thereof allowing the new upper end of the assembled riser string to be engaged by the riser spider device, characterized in that the vessel comprises a controlled riser spider displacement actuator that is adapted to displace—in at least one horizontal direction, e.g. in a direction parallel to the longitudinal axis of the vessel—the riser spider device or at least a riser dogs carrying part thereof relative to the hull of the vessel, e.g. relative to the working deck, and thereby relative to the riser string lifting tool at least whilst the riser spider device is disengaged from the riser string and whilst said riser string lifting tool travels between said elevated and lowered position thereof and the riser string is suspended from the riser string lifting tool, thereby allowing to establish an inclined travel path with selectively variable inclination of the riser string lifting tool relative to an imaginary vertical line through the riser string passage of the riser spider device, e.g. said inclined travel path having an inclination selected to correspond to an actual water current induced inclination of an upper portion of the riser string during the riser string assembly process.

In an embodiment the riser spider device comprises a base and a riser dogs carrying part comprising multiple riser dogs that are movable between a retracted position, wherein the dogs are disengaged from the riser string, and an operative position, wherein the dogs are engaged with the riser string and support the riser string, In an embodiment the controlled riser spider displacement actuator is linked to a control unit that is also linked to one or more riser string centering sensors that are adapted to detect the actual position—in a horizontal plane—of the riser string relative to the riser string passage in the riser spider device, wherein said control unit is adapted to control said horizontal direction displacement on the basis of output of said one or more riser string centering sensors, e.g. in order to avoid contact between the riser string and the riser spider or riser dogs portion thereof during the passage of the riser string through the riser string passage of the riser spider device.

For example a dynamic positioning system of the vessel is present and is employed to maintain the riser string in a longitudinal plane of the riser passage, e.g. said plane being maintained parallel to water current, and wherein the riser spider displacement actuator is employed to perform controlled motion of the riser spider, or just the dogs carrying part thereof, in one direction parallel to said longitudinal plane so as to be able to compensate for inclination of the riser string as the riser string is being run or tripped.

A fourth aspect of the invention relates to a method for performing a subsea wellbore related operation involving a riser string that is assembled from releasably interconnected riser sections and extends between a subsea wellbore and the vessel, e.g. drilling and/or wellbore intervention, wherein use is made of a vessel comprising:

- a floating hull; e.g. a mono-hull type hull, the hull having a bow,
- a riser storage adapted to store therein multiple risers sections,
- a moonpool in said hull,
- a tower arranged at said moonpool and fixed to said hull,
- a riser string vertical handling system comprising:
  - a riser string lifting tool mounted on said travelling device and adapted to connect to an end of a riser section, which riser string lifting tool is embodied to support the weight of a riser string,
  - a hoisting device by which said travelling device and/or said riser string lifting tool is suspended from the tower and which hoisting device is adapted to move the riser string connected thereto via the riser string lifting tool in unison with the travelling device up and down relative to the tower, preferably said hoisting device comprising at least one winch and at least one winch driven cable, wherein the travelling device and/or said riser string lifting tool is suspended from said at least one cable,
- a riser spider device that is supported above the water in the moonpool and is adapted to temporarily suspend therefrom a riser string into the sea at least during the riser assembly and disassembly process, which riser spider device has a riser string passage therein through which the riser string passes, preferably said riser spider device being mounted on a working deck which extends, e.g. in an operative position thereof, above at least an area of the water in the moonpool, wherein—in a riser string assembly process—an assembled riser string is temporarily suspended from the riser spider device and a new riser section is connected to the riser string lifting tool and positioned above an upper end of the assembled riser string and then connected thereto, after which the riser spider device is disengaged from the riser string and the riser string is lowered by the riser string vertical handling system wherein the riser string lifting tool moves from an elevated position to a lowered position thereof allowing the new upper end of the assembled riser string to be engaged by the riser spider device, wherein the vessel also may comprise a water ballast system including water ballast tanks for ballasting the vessel, characterized in that in the process of the riser assembly and/or disassembly, with the bow of the vessel facing into a water current, the vessels water ballast system is used to tilt the hull of the vessel with its bow downwards thereby effectively inclining the tower relative to an imaginary line vertically through the riser spider device. The water ballast tilting of the hull is e.g. done over an angle corresponding to, at least in part, an actual water current induced inclination of an upper portion of the riser string during the riser string assembly and/or disassembly process. For example the tilting of the hull by means of the water ballast is about 1°. This tilting of the hull may be employed as an alternative to the first aspect of the invention, e.g. in an embodiment wherein no controlled motion device is present, or may be combined with the first aspect of the invention. The latter may e.g. be done to extend the angular inclination window which the riser string can assume during the process, e.g. allowing to extend the current conditions in which the assembly and/or disassembly of the riser string can take place.

It will be appreciated that such an approach allows assist the operation of the discussed controlled motion device in the establishing of the inclined travelling path of the riser lifting tool, e.g. in order to enlarge the effective angular operating window of said motion device, e.g. allowing to deal with stronger currents.

It will be appreciated that the third aspect and/or fourth aspects of the invention could be combined with an embodiment of the riser string vertical handling system wherein the riser string lifting tool can only perform a purely vertical path motion between the elevated and lowered position.

The invention also relates to a method for performing a subsea wellbore related operation involving a riser string that is assembled from releasably interconnected riser sections and extends between a subsea wellbore and the vessel, e.g. drilling and/or wellbore intervention, wherein use is made of a riser spider device and or vessel according to one or more of the aspects of the invention.

The invention also relates to a riser spider device as described herein and a vessel equipped with such a riser spider device, as well as to a method for assembly of a riser string wherein use is made of such a riser spider device.

It will be appreciated that any technical feature, whether optional or not, described herein with respect to one aspect of the invention may readily be combined with each of the other aspects of the invention.

The invention will now be described in more detail with reference to the drawings.

DETAILED DESCRIPTION OF EMBODIMENTS

Figure 1:
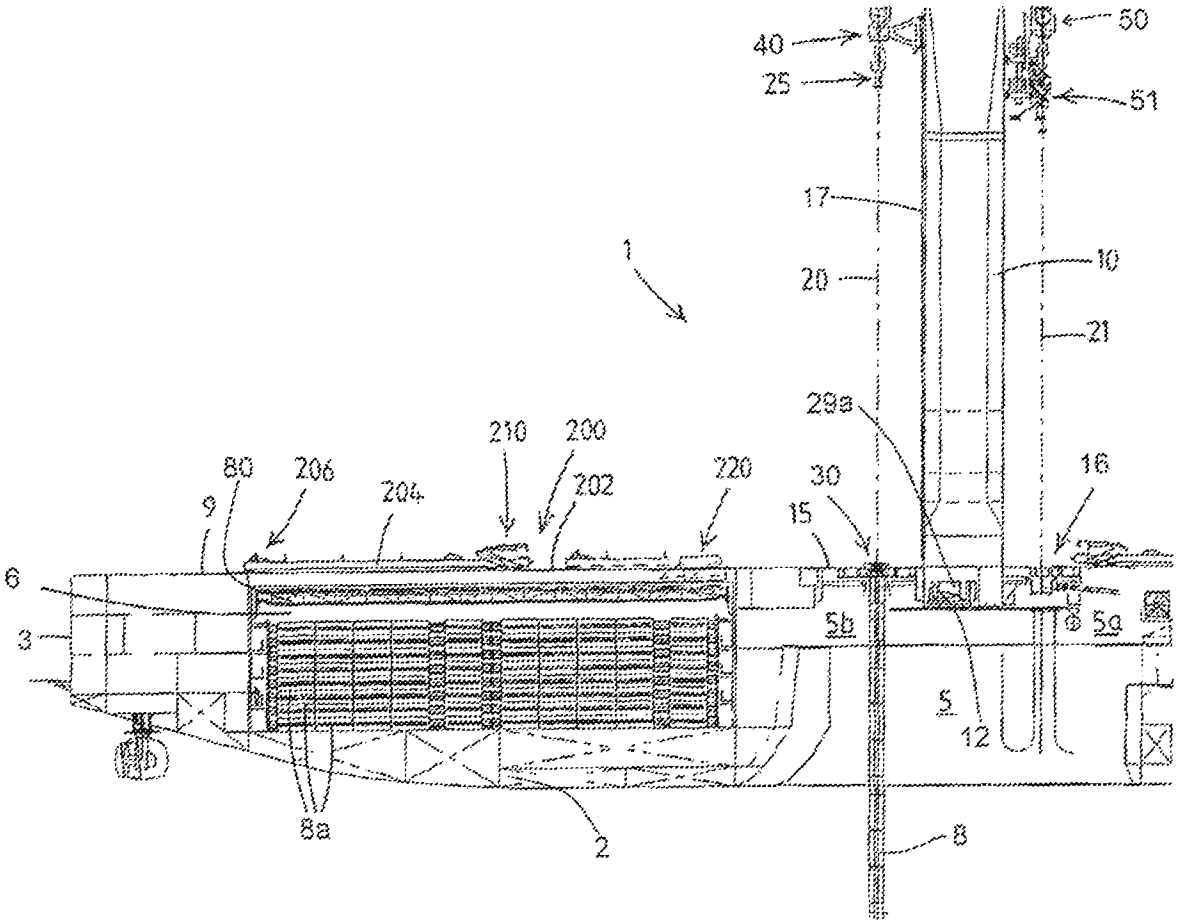
FIG. 1 shows in longitudinal cross section a part of a vessel according to the invention.

FIG. 1 shows a part of a mono-hull vessel 1 having a hull 2 with a bow, a stern 3, and a moonpool 5 that extends through the hull 1.

The vessel 1 is adapted to perform subsea wellbore related operations involving a riser string between the subsea wellbore and the vessel, in particular drilling operations, e.g. for exploratory drilling. The vessel can also perform other subsea wellbore related operations, e.g. wellbore intervention.

The moonpool 5 has, as is preferred, a generally rectangular shape with opposed lateral sides, a front side and a rear side.

A front main deck extends between the moonpool 5 and the bow.

A rear main deck 9 extends between the moonpool 5 and the stern 3 of the vessel.

The vessel is equipped with a tower 10, which is, as is preferred, embodied as a hollow construction mast having a top 11 and having a base 12 that is integral with the hull 2. The base 12 extends between sections of the hull on opposed lateral sides of the moonpool 5 and the base 12 is spaced from each of the front side and the rear side of the moonpool, thereby forming a front moonpool area 5*a* forward of the mast 10 and a rear moonpool area 5*b* rearward of the mast 10.

The tower 10 is fixed to the hull. The tower 10 is not inclinable relative to the hull.

For example, drilling tubular racks, e.g. embodied as carrousel type racks, may be located adjacent the lateral sides of the mast 10, as is known in the art, e.g. for storage of drill pipe.

At the rear moonpool area 5*b*, the vessel is provided with a working deck 15 arranged above the rear moonpool area 5*b*.

As is preferred the working deck 15 is a mobile working deck, e.g. pivotable, slidable, and/or liftable, e.g. allowing to bring a blow-out preventer BOP above the rear moonpool area 5*b*. In view of assembly and disassembly of a riser string along a firing line 20 through the rear moonpool area 5*b* the vessel is equipped with a riser spider device 30 that is adapted to temporarily suspend therefrom a riser string 8 in the firing line 20 into the sea during the riser string assembly and disassembly process.

As preferred, this riser spider device 30 is mounted on the working deck 15, thereby requiring that the working deck 15 is adapted to support the weight of the riser string 8, e.g. with a BOP and/or other subsea equipment at the lower end of the riser string.

The vessel 1 has a riser string vertical handling system including a riser string lifting tool 25 which is movable up and down relative to the mast 10 and that is adapted to connect to an end of a riser section 8*a*, and is embodied to support the weight of a riser string 8 in the firing line 20 when released from the riser spider device 30.

The riser string lifting tool 25 here is suspended from a travelling device 40 that is movable up and down along a side, here the rear side, of the mast 10 along one or more vertical rails 17.

The hanger device 40 is suspended by one or more cables 28 from a sheave arrangement 29 at the top of the mast 10, which one or more cables 28 are connected to one or more winches 29*a*, e.g. arranged within the mast 10.

It is noted that the firing line 20 is outside of the mast 10, here along the rear side of the mast 10, so that the firing line 20 can be reached without hindrance in the process of upending a riser section 8*a* or riser stand.

In an alternative embodiment, the mast 10 is replaced by a derrick type tower having a latticed frame with corner posts that forms a frame extending over the moonpool 5. It is then envisaged that the riser storage is outside of the derrick type tower and the derrick is provided with a V-door or similar to allow passage of a riser section or riser stand into and out of the derrick.

The vessel also has a second hoisting device having a load attachment device 50 which is movable up and down relative to the mast at a side opposed from the riser firing line 20, so as to allow for handling of items passing through the other moonpool area 5*a* along a second firing line 21 distinct and spaced from the first firing line 20 where the riser string assembly, also known as riser running, and disassembly, also known as tripping, takes place.

The second firing line 21 extends through the front moonpool area 5*a*. Along this firing line 21 primarily drilling operations are performed.

The second hoisting device is embodied as a drilling drawworks, and is provided with a topdrive 51 suspended from the load attachment device 50 to perform drilling operations. The load attachment device 50 is preferably embodied similar as the travelling device 40.

A working deck 16 is arranged above the moonpool area 5*a* and may include a rotary table, iron roughneck machine, etc.

The vessel 1 is thus capable of assembly of a riser string in firing line 20. For transfer of the riser string to the other firing line 21 a riser string support cart with a second riser spider device is provided. This cart is displaceable within the moonpool, e.g. skiddable over rails along the lateral sides of the moonpool 5.

The vessel 1 has a riser storage, here embodied as a storage hold 40, here as is preferred, within the hull 2 aft of the moonpool 5. The riser storage 40 is embodied to store the riser sections 8*a* therein in horizontal position and parallel to a longitudinal axis of the vessel 1.

The hold 40 is covered here by a roof that is formed by the rear main deck 9 so that in practice the riser sections in the hold 40 are not visible from above.

The riser storage hold 40 is adapted to store therein, or has stored therein, multiple riser sections 8*a*, e.g. individual riser sections or pre-assembled riser stands, e.g. at least 25 riser sections 8*a*. A riser stand is assembled from multiple individual riser sections connected end-to-end. A riser stand may, as preferred, consists of two riser sections. Each riser section comprises a riser pipe and optionally one or more auxiliary pipes on the outside of and along the riser pipe as is known in the art. Each riser section comprises a connector fitting arrangement, e.g. including a flange, at each end thereof. Preferably, and as common in this field, riser sections comprise buoyancy members.

The riser storage 40 comprises one or more riser storage racks 41 adapted to store therein multiple riser sections 8*a* in horizontal orientation.

A riser section 8*a* may have a length that exceeds common riser sections, e.g. the common length being 75 ft. In this example the riser sections 8*a* each have a length of 150 ft. (45.72 m). The riser storage hold 40 is provided with an elongated riser stand transfer opening having a length and a width so as to allow for transfer, e.g. by lifting, of a single riser section 8*a* in horizontal or substantially horizontal (e.g. less than 30 degrees inclination) orientation via said riser stand transfer opening out of and into the riser storage hold 40.

Within the hold 40 a handling crane 80 is provided, here embodied as a travelling overhead beam crane with crane rails transverse to the vessel and with a crane beam from which riser grippers or the like are suspended by means of winched cables. The crane 80 is adapted to lift and lower a riser section 8, e.g. for removing a riser stand from a stack and placing a riser stand back into the stack. The crane 80 allows for transverse transportation of a lifted riser section 8*a* within the hold 40 to a transfer station of the riser storage. This transfer station is provided with a transfer elevator that is adapted to raise and lower a riser section in horizontal orientation thereof so as to pass the riser section through the transfer opening. The opening is oriented with its length towards the moonpool 5, here, as preferred, along a central axis of the vessel 1.

In order to bring the connector fitting arrangement at the lower end of the upended riser 62 onto the top end fitting of the launched riser string the hanger device 26 is somewhat lowered, but in an alternative the subframe 87 is used to effect this motion of the riser stand 62. The connection to the deployed riser string can now be made, e.g. by application of bolts and nuts as is known in the art to interconnect flanges of the riser sections to be joined.

After the connection has been made and tested, the device 17 is released so that the entire riser string becomes suspended from the hanger device 26. Then the riser string is lowered by means of winch 29*a* and cable(s) 28 until the top end thereof can again be secured by means of device 17. In the process of this lowering of the riser string, the strongback 80 is moved towards its transfer position. Then the process of supplying and upending a riser stand can start anew.

It will also be possible to lower the riser string such that it can become suspended from the cart 35 within the moonpool 5. The string can then be shifted to the firing line 21, e.g. to perform drilling operations with a drill string driven by topdrive 31, with the drill string within the riser string.

In a preferred embodiment the cart 35 is provided with a gimballing riser string hanger device, to allow for relative motion between the riser string and the vessel.

At the front moonpool area 5*a* a riser tensioner system may be provided to suspend the riser string during drilling operations or the like that are conducted through the riser string.

In a slightly different sequence one can envisage that a new riser stand 62 is already moved upward through the opening 45 by means of the elevator 57 ahead of the strongback 80 being returned to its transfer position. So then the frame moves over the riser stand 62 and then the stand 62 is secured to the frame. This approach may be used to save time in the assembly process of the riser string.

It will be appreciated that first a blow-out preventer can be positioned at the rear moonpool area 5*b*, so that the BOP is at the lower end of the riser string.

Once riser handling is no longer required, the strongback frame together with the travelling carriage is lowered into the riser stand transfer opening 45 by means of the transfer elevator 57.

The topside of the strongback frame, and here also of the carriage, is embodied as a deck portion that is flush with an adjacent deck area 9 when the strongback has been lowered into the opening 45 into its the docking position.

It is envisaged that the vessel may be equipped with a mobile catwalk machine 135 that is embodied to handle single riser sections as is known in the art.

It is envisaged that, e.g. for handling a first riser section to be connected to the top of a blow-out preventer, this catwalk machine 135 can be positioned on top of the topside of the strongback frame in its docking position, so that the riser section or other tubular can be supplied to the firing line 20. For example the catwalk machine 135 is moved by means of crane 130, but one can also envisage that the machine 135 is placed "in line" with the rails 85 of the strongback and moved in said direction from a stern-side non-operative position to an operative position near the moonpool 5. For example the machine 135 is then moved over the same rails 85 as the strongback.

The vessel 1 may comprise a solid mass ballast device may be embodied to act—if desired—as active roll damping mechanism, the device further including:

- a sensor detecting the rolling motion of the hull, and
- a drive and control system operable to cause and control the movements of the solid ballast in response to the detections of the sensor to provide roll stabilization. For example a winch and cable arrangement is provided to move the ballast masses, either continuously in synchronization with sea-motion of the vessel or to a desired position to obtain a balancing moment.

The vessel also may comprise a water ballast system including ballast tanks for ballasting the vessel.

In an embodiment of the riser assembly and/or disassembly process it is envisaged that, with the bow of the vessel facing a water current, the vessels water ballast system is used to tilt the hull of the vessel with its bow downwards, e.g. over an angle of at most 5°, e.g. of about 1° or 2°, therefor effectively inclining the tower 10 relative to a line vertically through the riser spider device 30. It will be appreciated that such an approach allows assist the operation of the discussed motion device in the establishing of the incline travelling path of the riser lifting tool 25, e.g. in order to enlarge the effective angular operating window of said motion device, e.g. allowing to deal with stronger currents. This inclination of the entire vessel 1 by use of the water ballast system may also be used as a complete alternative of the provision of the discussed motion device.

The vessel 1 further comprises a riser horizontal handling system comprising a riser section handling catwalk machine 200.

In the exemplary embodiment shown, the catwalk machine 200 is arranged on a deck 9 and above the riser storage hold 40. The catwalk machine 200 comprises a pair of horizontal catwalk machine rails 202, an elongated catwalk machine frame 204 movable over the catwalk machine rails, and a skate 206 that is movable supported by the frame.

The catwalk machine frame 204 has a rear end and a front end, and is movable over the catwalk machine rails at least in a rearward loading position and a forward riser release position. In the rearward loading position a riser section 8*a* in horizontal orientation can be loaded onto the catwalk machine, and in the forward riser release position a riser section 8*a* to be lifted is connectable to the riser string lifting tool 25.

The skate 206 comprises a riser end support to support thereon a rearward end of a riser section 8*a*. The skate 206 is supported by the catwalk machine frame 204, and may be movable by a drive motor along the length of the frame between a rearward skate position and a forward skate position.

The riser horizontal handling system further comprises, as an optional feature thereof, a riser forward section auxiliary support device 220, that is distinct from the catwalk machine 200.

The auxiliary support device 220 is arranged at a location along the catwalk machine rails 202 between the moonpool 5 and the catwalk machine frame 204, when in its rearward loading position.

The auxiliary support device 220 is movable between an operative position and a retracted position. Both positions are depicted in FIG. 1. The auxiliary support device 220 has been depicted in its operative position in full lines, and in its retracted position in dashed lines.

The riser forward section auxiliary support device 220 is adapted to, in its operative position, support a forward section of a riser section 78*a* that rests with its rear end on the skate 206 and that extends beyond the front end of the catwalk machine frame.

The riser section 8*a* has been loaded in horizontal orientation onto the catwalk machine 200 whilst the latter was in its rearward loading position. Thus, with a riser section 8*a* loaded onto the catwalk machine 200 and also supported by the riser forward section auxiliary support device 220, the catwalk machine frame is movable along said catwalk machine rails towards the auxiliary support device 220 in which advancing motion the forward riser section is supported by said auxiliary support device. In the particular embodiment shown, this is possible whilst maintaining its horizontal orientation.

The forward riser end can thus be brought near the riser string lifting tool 25 and allow for connection thereof to the forward riser end.

The riser forward section auxiliary support device 220 can furthermore be moved into its retracted position, after connecting the forward riser end to the riser string lifting tool 25. Thus, the support device 220 disengages from the riser section 8*a* and allows the catwalk machine frame 204 to move further towards its forward position in the process of bringing the riser vertically into the firing line, wherein the forward end of the riser is lifted by the riser string vertical handling system.

In the preferred embodiment shown the catwalk machine 200 is provided with a tailing-in arm device 210 that is mounted at the forward end of the catwalk machine frame 202. The tailing-in arm device thus moves along with the catwalk machine, and therefore forms no obstacle near the firing line when the catwalk machine is retracted, e.g. when not in use. In an alternative the tailing-in arm device is supported on the vessel in a different manner, e.g. mobile in the tower.

Figure 2:
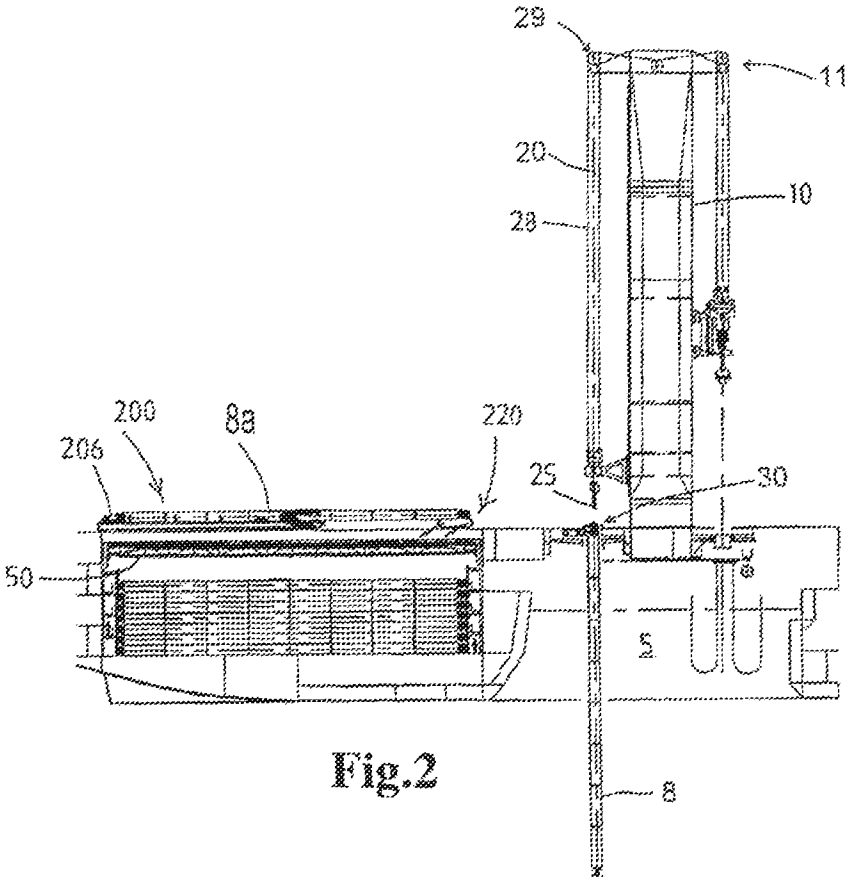
FIG. 2 illustrates a step in the assembly process of a riser string with the vessel of FIG. 1.
Figure 3:
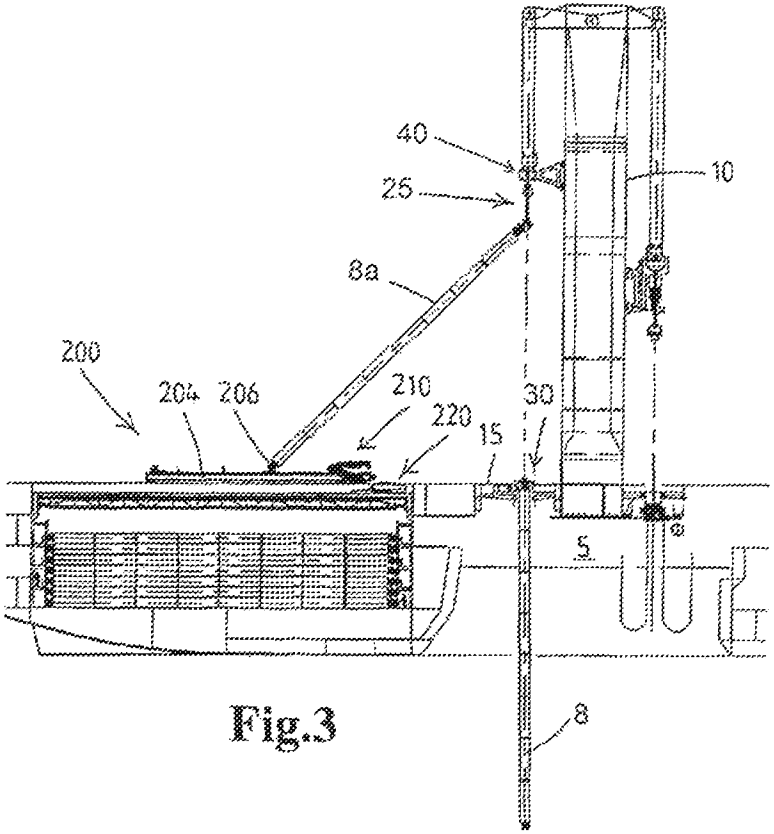
FIG. 3 illustrates a further step in the assembly process of the riser string.
Figure 4:
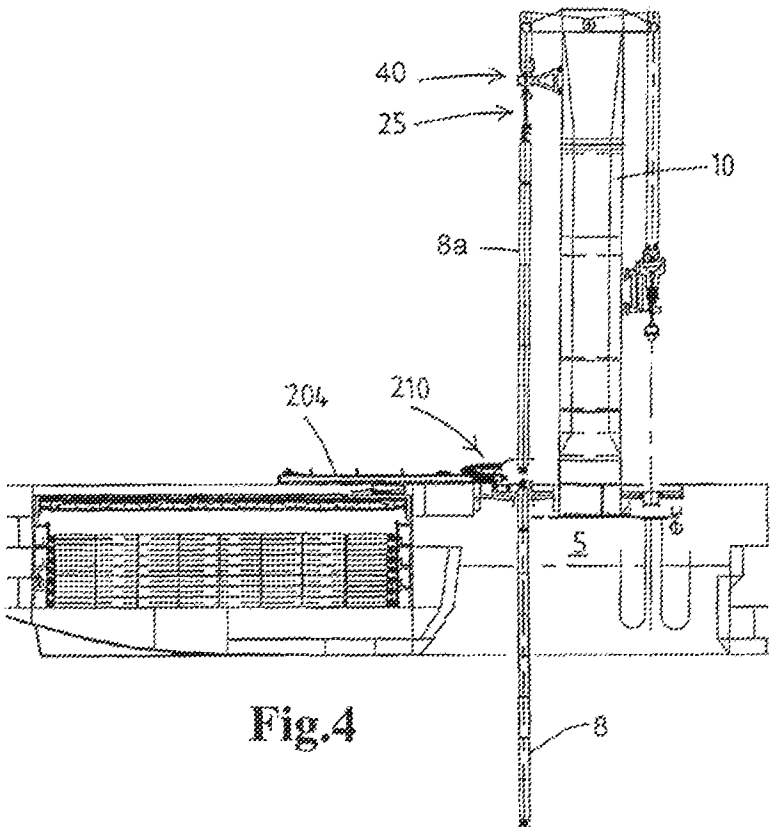
FIG. 4 illustrates a further step in the assembly process of the riser string.

The operation of the vessel according to the invention during the process of assembly of a riser string along the firing line 20 will be first discussed in general terms with reference to FIGS. 2-4.

In FIG. 2 a launched portion of the riser string 8 is suspended from the riser spider device 30. A new riser section 8*a* has been retrieved from the storage 8 and placed on the catwalk machine 200 and auxiliary support device 220. The riser lifting tool 25 has been lowered to the level of the still horizontal riser section 8*a*, so that in a subsequent step the riser section 8*a* can be advanced to the firing line 21. Then the forward end of the riser section 8*a* is connected to the tool 25.

In FIG. 3 it is depicted that the riser section 8*a* is being raised at one end thereof by means of the vertical handling system, whilst the catwalk machine skate 206 supports the other end of the riser section 8*a*. The lifting is continued until the riser section 8*a* becomes suspended from the tool 25.

FIG. 4 illustrates that the tailing-in arm device 210 has been employed to guide the rear or now lower end of the riser section 8*a* as the riser section 8*a* reaches its vertical position in the firing line 20. In FIG. 4 the new section 8*a* is not yet connected to the upper end, commonly embodied as a flange, of the riser section at the top of the launched riser string 8.

Figure 5:
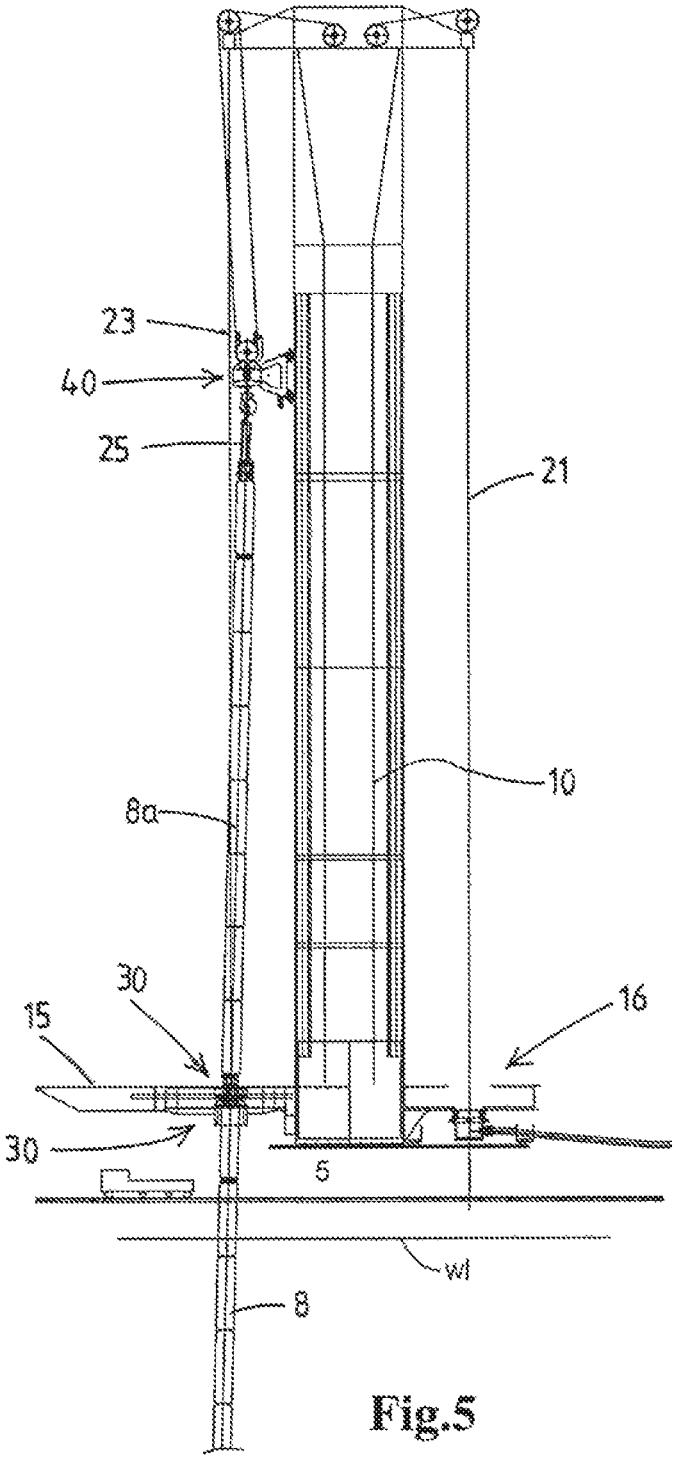
FIG. 5 illustrates that the new riser section has been connected to the upper end of the riser string held by the riser spider device, which riser string has an inclination due to water current.

As explained, in practice, the launched riser string 8 may be subject to such a water current that the riser string 8 assumes an inclination. Commonly, especially if a significant current is present, the vessel 1 is directed with its bow into the current, so that the water current induced inclination is in the longitudinal plane of the vessel 1 with the launched riser string 8 diverging rearward from a line 23 that is vertically through the passage of the riser spider device 30. An example of this situation is depicted in FIG. 5. In practical terms this inclination may be one or just a few degrees, but as will be shown below even a seemingly small inclination may significantly impact the process of assembly of the riser string.

FIG. 5 shows that the lower end of the new section 8*a* has been connected, e.g. bolted, to the upper end of the inclined riser string 8 held in the riser spider device 30. In order to keep the new riser section aligned—as to the inclination thereof—with the upper part of the launched riser string 8 the lifting tool 25 has been moved closer to the tower 10 away from the line 23.

Figure 8:
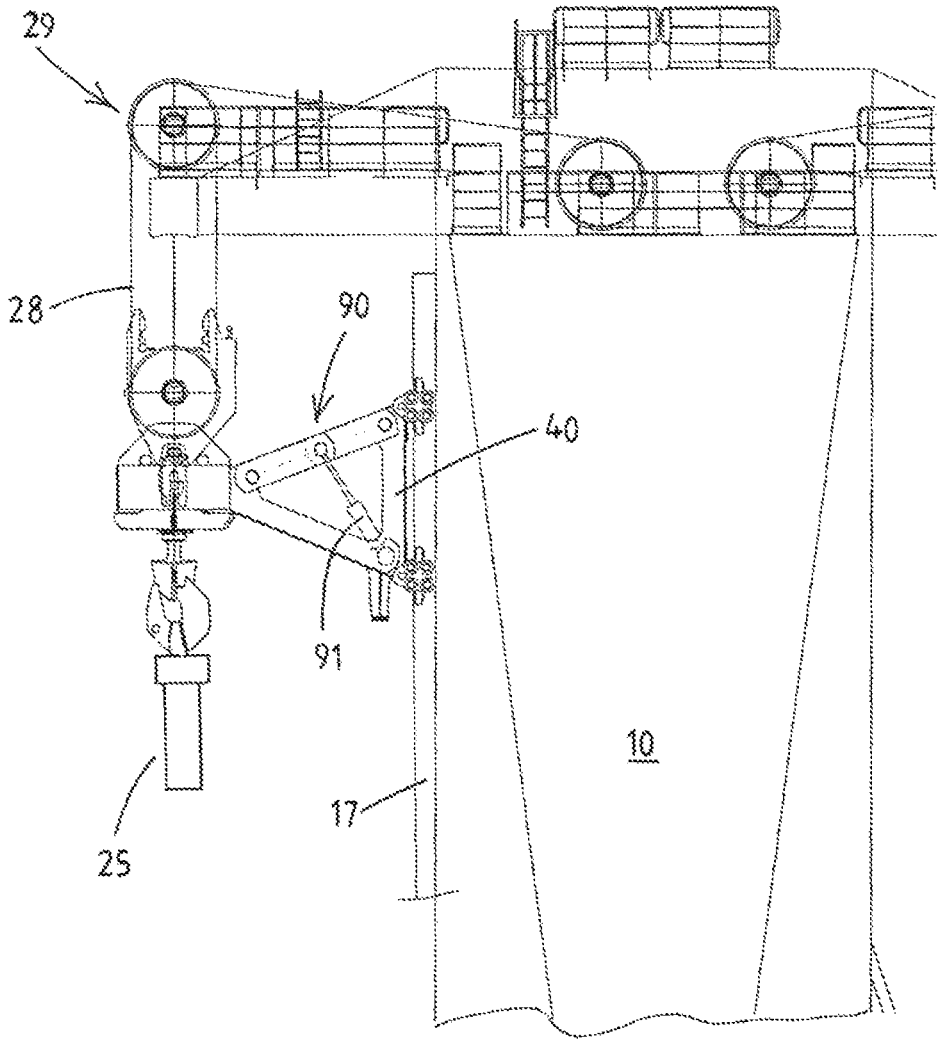
FIG. 8 illustrates an embodiment of a travelling device in a vessel according to the invention.

For example, as shown in FIG. 8, the riser string lifting tool 25 is displaceable mounted on the travelling device so as to allow displacement of the riser string lifting tool relative to the travelling device in one horizontal direction, here in the longitudinal plane of the vessel so towards and away from the mast 10.

A controlled motion device 90, here including one or more hydraulic cylinders 91, is arranged between the riser string lifting tool 25 and the travelling device 40.

As the riser section is 150 ft. and in case the inclination is about 1° the horizontal position of the tool may be about 0.5 meter away from the line 23, closer to the tower. This shows that, when desiring to handle 150 ft. length riser sections, it is preferred for the motion device 90 to provide a motion range in at least one horizontal direction of at least 0.5 meter.

Figure 6:
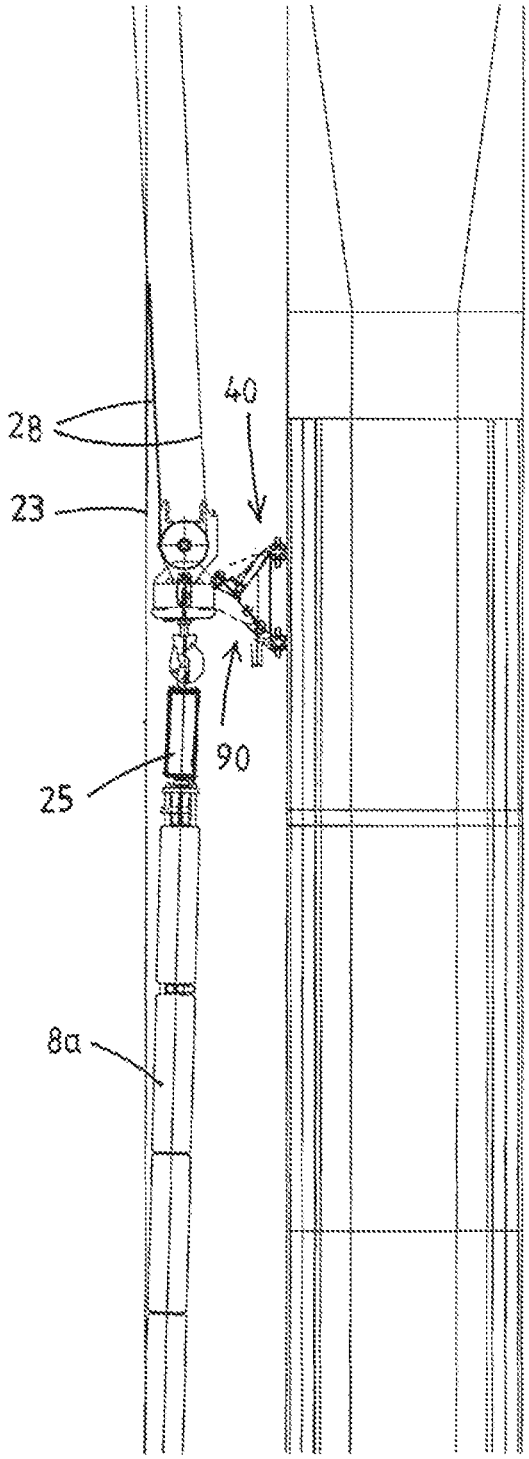
FIG. 6 shows a portion of FIG. 5.

In FIG. 6 it is illustrated that the riser lifting tool 25 is directly suspended from the cable 28, so that the device 40 merely serves to guide the tool 25 relative to the tower and does not support the weight of the riser string 8 during the assembly and/or disassembly process.

Figure 7:
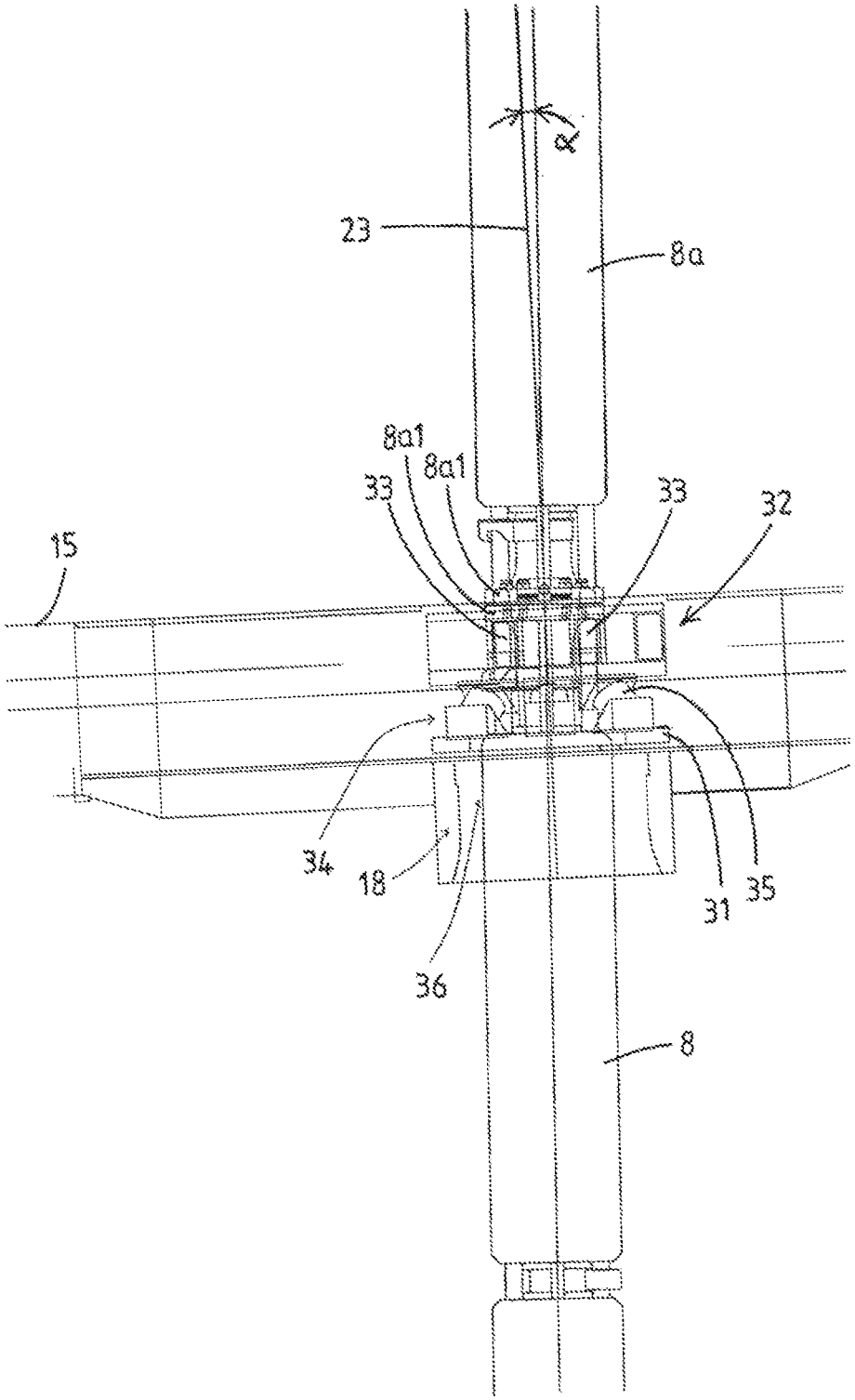
FIG. 7 illustrates the engagement of the riser spider device on the riser string in the situation of FIG. 5.

FIG. 7 illustrates the riser spider device 30 in more detail. In this example, as is preferred, it is assumed that the riser spider device 30 is stationary mounted in or on the working deck 15 and maintains its position during the riser assembly process relative to the tower 10.

The riser spider device comprises a base 31 and a dogs carrying part 32 comprising multiple dogs 33 that are movable between a retracted position wherein the dogs are disengaged from the riser string and an operative position wherein the dogs are engaged with the riser string and support the riser string.

The riser spider device 30 also comprises a gimballing portion 34 between the base 31 and the dogs carrying part 32, in this example with resilient damper members 35 as is known in the art. Due to the presence of the gimballing portion 34 the riser dogs carrying part 32 is inclinable relative to the base 31, e.g. allowing the riser dogs carrying part to have an inclination corresponding to the actual water current induced inclination of an upper portion of the riser string 8.

A riser passage 36 extends through the riser spider device, e.g. having smallest diameter of 60 inch for a 54 inch maximum diameter riser string 8.

In FIG. 7 an annular bumper device 18 is shown at the underside of the working deck 15, below the riser spider device 30. As discussed it is envisaged that contact, or at least damaging contact, between the riser string (whilst inclined due to water current) and the riser spider 30 is avoided as the string 8 is lowered or raised through the disengaged riser spider device 30 in the process of assembly or disassembly of the riser string 8. The bumper device 30 has a diameter similar to the riser spider passage 36 and is designed to withstand such contact and has a flared or rounded lower region to avoid damage.

Figure 9:
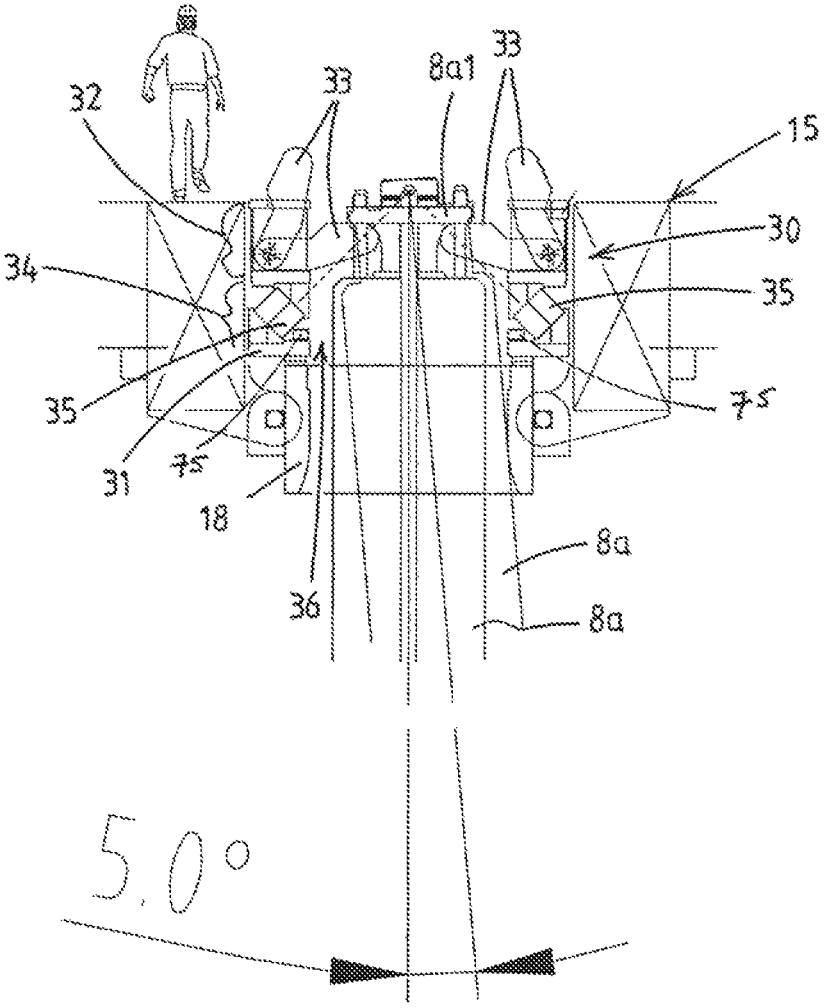
FIG. 9 illustrates the riser spider device of the vessel of FIG. 5.

FIG. 9 depicts the riser spider device 30 with dogs 33 both in retracted, here upwardly pivoted, position and in extended or deployed position supporting the riser string 8, here extending below a flange **8*a*1 of riser section 8*a*. The riser spider device 30** allows for a maximum inclination of the riser string of 5°.

The invention envisages that, starting from the initial position in FIG. 5, the riser spider device 30 is disengaged from the launched riser string 8, here by retraction of the dogs 36, so that the entire riser string including the new section **8*a* becomes suspended from the tool 25**.

Then, as in the prior art, the tool 25 is lowered by means of the cable 28 and winch **29*a***.

In contrast with the prior art, the tool 25 is now not lowered in a vertical path, here parallel to the mast 10, but due to appropriate operation of the motion device 90 the riser string lifting tool 25 is moved in at least one, here just one, horizontal direction relative to the riser spider device 30 whilst travelling between the elevated position of FIG. 6 and a lowered position thereof. During this lowering the tool 25 supports the weight of the entire riser string 8 that is suspended from the riser string lifting tool.

The motion device 90 is operated such that an inclined travel path for the lifting tool 25 towards its lower position is established having an inclination relative to the imaginary vertical line 23 through the riser string passage of the riser spider device 30. This inclination is depicted with a in FIG. 7.

As explained this inclined travel path preferably has an inclination that is selected to correspond to the actual water current induced inclination of an upper portion of the riser string during the riser string assembly process. So, seen in horizontal plane, as the tool 25 is lowered the tool 25 also moves gradually closer to the center of the riser spider device passage so that in the end the top end of the riser string is rather precisely centered with respect to the riser spider device.

This approach greatly contributes to the avoidance of potentially damaging collisions between the riser string 8 and the disengaged riser spider device 30. It will be appreciate that a similar approach can be used when tripping the riser string.

The riser spider device 30 is provided with centering sensors 75 as discussed herein, e.g. mounted on the base 31.

Figure 10:
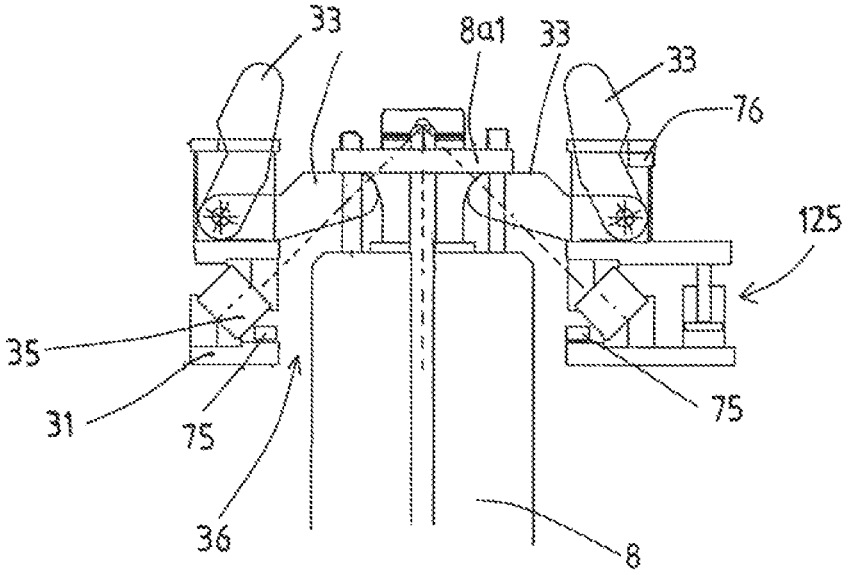
FIG. 10 illustrates an embodiment of an inventive riser spider device.

The riser spider 30 also has an inclination sensor 76 that senses the inclination of the part 32 relative to the base 31. For example the sensor 76 is mounted on the part 32 as can be seen in FIG. 10.

Figure 11:
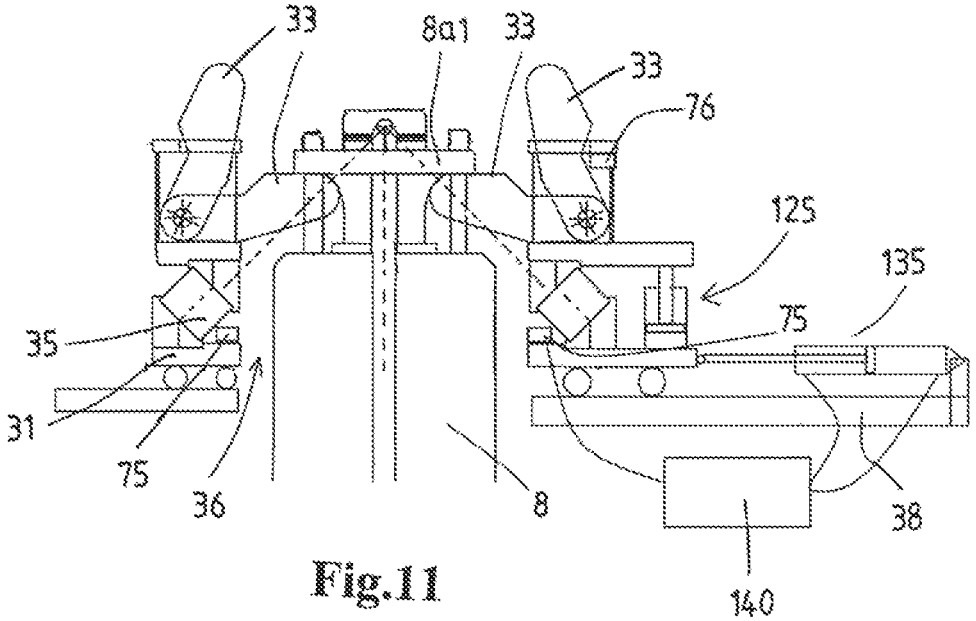
FIG. 11 illustrates an embodiment of an inventive riser spider device mounting on a vessel.

FIG. 11 schematically depicts a mobile mounting of the entire riser spider device 30 relative to the hull 2, here on rails 38, so as to be displaceable in at least one, here just one, horizontal direction, e.g. parallel to be main longitudinal axis of the hull.

Furthermore FIG. 11 illustrates schematically the provision of a controlled riser spider displacement actuator 135 which is linked to a control unit 136 that is also linked to one or more riser string centering sensors 75. For example the control unit 140 is adapted to control horizontal direction displacement of the entire riser spider device 30 on the basis of output of said one or more riser string centering sensors 75, e.g. in order to avoid contact between the riser string 8 and the riser spider 30 or riser dogs part 32 thereof during the passage of the riser string 8 through the riser string passage of the disengaged riser spider device 30.

What is claimed is:

1. A riser spider device comprising:

a base;

a gimballing part; and a riser dogs carrying part comprising multiple riser dogs, wherein the riser dogs are movable between a retracted position where the riser dogs are disengaged from a riser string, and an operative position where the riser dogs are engaged with the riser string and support the riser string, wherein the gimballing part is configured to allow for the riser dogs carrying part to be inclinable relative to the base, at least about one axis, thereby, in operation, allowing the riser dogs carrying part to have an inclination corresponding to an actual water current induced inclination of an upper portion of the riser string suspended from the riser spider device, and wherein the riser spider device is provided with a controlled inclination actuator that is arranged between the base and the riser dogs carrying part and that is configured to selectively vary the inclination of the riser dogs carrying part relative to the base while the riser spider device is disengaged from the riser string.

2. The riser spider of claim 1, wherein the gimballing part comprises resilient members and/or spring members that restore the dogs carrying part to a non-inclined, horizontal, position once the spider device is disengaged from the riser string.

3. The riser spider of claim 1, wherein the riser spider device is provided with an inclination sensor that measures an actual inclination of the riser dogs carrying part relative to the base.

4. The riser spider of claim 1, wherein the controlled inclination actuator of the riser spider device is adapted to cause controlled inclination of the riser dogs carrying part about solely a single horizontal axis.

5. The riser spider of claim 1, wherein the controlled inclination actuator is linked to a computerized control unit that is configured to select and set the inclination of the riser dogs carrying part to correspond to the actual water current induced inclination of an upper portion of the riser string during a riser string assembly process prior to engagement of the riser string with the riser dogs.

6. A vessel adapted to perform subsea wellbore related operations involving a riser string that is assembled on board said vessel floating at sea from releasably interconnected riser sections, the riser string extending between a subsea wellbore and said vessel, wherein the vessel is provided with the riser spider of claim 1.

7. The vessel according to claim 6, wherein said vessel comprises:

a floating hull;

a riser storage adapted to store therein multiple risers sections;

a moonpool in said hull;

a tower arranged at said moonpool and fixed to said hull;

a riser string vertical handling system comprising:

a travelling device that is movable up and down along the tower;

a riser string lifting tool mounted on said travelling device and adapted to connect to an upper end of a riser section, said riser string lifting tool being embodied to support a weight of the riser string; and a hoisting device by which said travelling device and said riser string lifting tool is suspended from the tower and which hoisting device is adapted to move the riser string connected thereto via the riser string lifting tool up and down relative to the tower; and a riser spider device that is supported above the water in the moonpool and is adapted to temporarily suspend therefrom the riser string into the sea, said riser spider device having a riser string passage therein through which the riser string passes, wherein the riser string is temporarily suspended from the riser spider device and a riser section is connected to the riser string lifting tool and positioned above an upper end of the riser string and then connected thereto, after which the riser spider device is disengaged from the riser string and the riser string is lowered by the riser string vertical handling system, wherein the riser string lifting tool moves from an elevated position to a lowered position thereof allowing the upper end of the riser section to be engaged by the riser spider device, and wherein the vessel comprises a controlled riser spider displacement actuator that is adapted to displace, in at least one horizontal direction, the riser spider device or at least the riser dogs carrying part thereof relative to the hull of the vessel, and thereby relative to the riser string lifting tool at least whilst the riser spider device is disengaged from the riser string and whilst said riser string lifting tool travels between said elevated and lowered position thereof and the riser string is suspended from the riser string lifting tool, thereby allowing to establish an inclined travel path with selectively variable inclination of the riser string lifting tool relative to an imaginary vertical line through the riser string passage of the riser spider device.

8. The vessel according to claim 7, wherein the controlled riser spider displacement actuator is linked to a control unit that is also linked to one or more riser string centering sensors that are adapted to detect the actual position, in a horizontal plane, of the riser string relative to the riser string passage in the riser spider device, and wherein said control unit is adapted to control said horizontal direction displacement on the basis of output of said one or more riser string centering sensors.

9. A riser string assembly process onboard a vessel adapted to perform subsea wellbore related operations involving a riser string, wherein said riser string is assembled onboard said vessel floating at sea from releasably interconnected riser sections, wherein use is made of a riser spider device according to claim 1, and wherein the controlled inclination actuator is operated to bring the riser dogs carrying part in a selected inclined orientation.

10. The riser string assembly process of claim 9, wherein the controlled inclination actuator is operated to bring the riser dogs carrying part in a selected inclined orientation ahead of the landing of the riser string onto the riser dogs.

11. The riser string assembly process of claim 9, wherein the controlled inclination actuator is brought in a free motion mode once the riser string is suspended from the riser spider, so that this actuator does not interfere with the gimballing effect provided by the gimballing part.

12. The riser string assembly process of claim 9, wherein a measurement of an actual inclination of the riser string is done prior to a release of the riser string from the riser spider device, and wherein said measurement is used as input to steer the inclination actuator of the riser spider device ahead of a subsequent landing of the riser string onto the riser dogs.

13. A vessel adapted to perform subsea wellbore related operations involving a riser string that is assembled on board said vessel floating at sea from releasably interconnected riser sections, the riser string extending between a subsea wellbore and said vessel, said vessel comprising:

a floating hull;

a riser storage adapted to store therein multiple risers sections;

a moonpool in said hull;

a tower arranged at said moonpool and fixed to said hull;

a riser string vertical handling system comprising:

a travelling device that is movable up and down along the tower;

a riser string lifting tool mounted on said travelling device and adapted to connect to an upper end of a riser section, said riser string lifting tool being embodied to support a weight of a riser string; and a hoisting device by which said travelling device and said riser string lifting tool is suspended from the tower and which hoisting device is adapted to move the riser string connected thereto via the riser string lifting tool up and down relative to the tower; and a riser spider device that is supported above the water in the moonpool and is adapted to temporarily suspend therefrom the riser string into the sea, said riser spider device having a riser string passage therein through which the riser string passes, wherein the riser string is temporarily suspended from the riser spider device and a riser section is connected to the riser string lifting tool and positioned above an upper end of the riser string and then connected thereto, after which the riser spider device is disengaged from the riser string and the riser string is lowered by the riser string vertical handling system, wherein the riser string lifting tool moves from an elevated position to a lowered position thereof allowing the upper end of the riser section to be engaged by the riser spider device, and wherein the vessel comprises a controlled riser spider displacement actuator that is adapted to displace, in at least one horizontal direction, the riser spider device or at least a riser dogs carrying part thereof relative to the hull of the vessel, and thereby relative to the riser string lifting tool at least whilst the riser spider device is disengaged from the riser string and whilst said riser string lifting tool travels between said elevated and lowered position thereof and the riser string is suspended from the riser string lifting tool, thereby allowing to establish an inclined travel path with selectively variable inclination of the riser string lifting tool relative to an imaginary vertical line through the riser string passage of the riser spider device.

14. The vessel according to claim 13, wherein the riser spider device comprises a base and a riser dogs carrying part comprising multiple riser dogs, wherein the riser dogs are movable between a retracted position where the dogs are disengaged from the riser string, and an operative position where the dogs are engaged with the riser string and support the riser string.

15. The vessel according to claim 13, wherein the controlled riser spider displacement actuator is linked to a control unit that is also linked to one or more riser string centering sensors that are adapted to detect the actual position, in a horizontal plane, of the riser string relative to the riser string passage in the riser spider device, and wherein said control unit is adapted to control said horizontal direction displacement on the basis of output of said one or more riser string centering sensors.

* * * * *